US006289709B1

(12) United States Patent
Geurts

(10) Patent No.: US 6,289,709 B1
(45) Date of Patent: Sep. 18, 2001

(54) GUTTER OUTLET PUNCH

(75) Inventor: Dennis G. Geurts, Paynesville, MN (US)

(73) Assignee: Malco Products, Inc., Annandale, MN (US)

( * ) Notice: Subject to any disclaimer, the term of this patent is extended or adjusted under 35 U.S.C. 154(b) by 0 days.

(21) Appl. No.: 09/565,754

(22) Filed: May 8, 2000

(51) Int. Cl.[7] ..... B21D 28/32

(52) U.S. Cl. ..... 72/327; 72/325; 83/140; 83/633; 83/684

(58) Field of Search ..... 72/325, 327, 409.01; 83/627, 684, 633, 629, 140

(56) References Cited

U.S. PATENT DOCUMENTS

| | | | | |
|---|---|---|---|---|
| 65,095 | * | 5/1867 | Lee | 83/633 |
| 1,571,672 | * | 2/1926 | Jayne | 83/140 |
| 1,890,956 | * | 12/1932 | Spengler | 83/627 |
| 3,613,491 | * | 10/1971 | Kahmann | 83/699 |
| 3,821,890 | * | 7/1974 | Dewey | 72/325 |
| 3,910,093 | | 10/1975 | Maloney, Jr. | 72/325 |
| 3,994,055 | * | 11/1976 | Maloney | 72/325 |
| 4,433,569 | * | 2/1984 | Santinelli | 72/409.01 |
| 4,945,796 | * | 8/1990 | Riley | 83/49 |
| 4,969,269 | * | 11/1990 | Dominguez | 83/685 |

OTHER PUBLICATIONS

Brochure from Don Wolters Corporation entitled "TD" (2 pp.).
Brochure from Omni Products entitled "Now! Eliminate those costly drop–outlets" (4 pp.).
Brochure from Petit Toll entitled "The Petit Outlet Punch" (3 pp.).
Brochure from Ode Gutter Products entitled "The Ode Punch*", (2 pp.).

* cited by examiner

*Primary Examiner*—Daniel C. Crane
(74) *Attorney, Agent, or Firm*—Rider, Bennett, Egan & Arundel

(57) ABSTRACT

A gutter outlet punch for punching an outlet in a rain gutter. The gutter outlet punch has a female die and a male cutting die mating with the female die with the rain gutter positioned therebetween. The male cutting die is attached to a rod. A ratchet permits incremental, one way movement of the male cutting die toward the rain gutter. A ratchet handle permits one-handed operation of the ratchet. A ratchet release allows the male cutting die to be moved away from the rain gutter. An alignment mechanism permits alignment of the rain gutter with the male cutting die in two alternate orthogonal orientations. A housing surrounds the female die and encloses the male cutting die to prevent contact with the operator when the apparatus is not in use. An automatic mechanism ejects the punched-out slug from the apparatus.

22 Claims, 5 Drawing Sheets

GUTTER OUTLET PUNCH

BACKGROUND OF THE INVENTION

The present invention relates to a sheet metal punch, and in particular to a gutter outlet punch for punching outlet holes in rain gutters.

Connection of downspouts to rain gutters has presented a number of problems that have not yet been solved.

The most usual connection has consisted of a flanged insert in a hole punched in the bottom of the rain gutter and projecting downwardly therefrom to be received in the upper end of a downspout. With such inserts it is difficult to provide a leak-proof joint between the gutter bottom and the insert. In addition, the flange of the insert at the joint presents a raised rim around the opening into the insert on which various debris such as leaves, sticks, and the like, can catch, and in any event to prevent complete drainage into the downspout so that weathering and deterioration are accelerated.

Some craftsmen have chiseled, hacksawed or otherwise cut downspout holes and have bent the material into downward tabs to facilitate alignment of the upper end of a downspout and connection thereto. However, as thus produced, the holes have been rough in outline and the tabs of rather crude formation. Because of the relative difficulty of practicing this method, it has required a rather high degree of skill to produce a reasonable workman-like result, and has consumed more installation time and labor than warranted.

Another disadvantage of all prior attempts to create effective downspout connections has been that at least some part of the connection of necessity had to be prefabricated or preformed before hanging of the gutter. At least the downspout hole was preformed. This has all too often resulted in misalignment of the downspout relative to the necessary or desired vertical position for the downspouts such as along a reentrant comer or an outside corner of a building or along or between windows, or the like and especially where some vertical line of reference can be compared with the vertical disposition of the downspout. Such misalignment has been caused by either miscalculation or tolerances and variables in the performing or prefabricating operations or in the installation of the gutter. In other words, prefabrication according to plan or according to measurements taken at the building site may be inaccurate either as taken or as executed or fail to take into consideration a subsequent change in plan or construction. Therefore unless the variation is extreme, downspout installation is generally permitted to proceed even though there is inevitable misalignment or at least noticeable deviation from true alignment.

Another problem with previous solutions for providing downspout connections has been the lack of a ratchet in the punch mechanism. Without such a ratchet, the installer must typically stand on a ladder and pull some sort of lever, causing a blade to punch a hole in the gutter. Ladders are often quite high and may be unstable, and the physical motion required to pull a lever may cause the installer to fall off the ladder.

An associated problem has been that two hands are required to operate the punch, one hand to hold the punch in place and the other to operate the handle. This prevents the installer from holding onto the ladder.

Still another problem with previous mechanisms has been that the punching blade is uncovered when the device is transported to and from the rain gutter, which may lead to the installer cutting his hands or other parts of his body on the unprotected blade.

Yet another problem of previous mechanisms has been that the installer has been required to manually remove the punched piece of metal, or slug, from the mechanism. The slugs have sharp edges, which may cause inadvertent cuts to the installer's fingers.

There is a need for a gutter outlet punch that solves the above-mentioned problems.

SUMMARY OF THE INVENTION

A gutter outlet punch for punching an outlet in a rain gutter, comprising:

(a) a female die;

(b) a male cutting die adapted to mate with the female die and punch a slug out of the rain gutter, the rain gutter being positioned between the male die and the female die for punching;

(c) a rod having a first end and a second end, the male cutting die being attached to the first end;

(d) a ratchet for incremental, one way movement of the male cutting die toward the rain gutter;

(e) a ratchet handle engaging the ratchet; and (f) a ratchet release.

A principal object and advantage of the present invention is that it allows a relatively unskilled, non-craftsman operator to punch rain gutter outlets.

Another principal object and advantage of the present invention is that the device may be taken to the work site and gutter outlets may be punched after the gutter is installed, to position the downspouts precisely where they are desired.

Another principal object and advantage of the present invention is that it has a ratchet that allows the operator to punch the slug out of the rain gutter using only one hand.

Another object and advantage of the present invention is that it allows the operator to use his other hand to hold onto the ladder or rain gutter, preventing a fall.

Another object and advantage of the present invention is that the operator is not required to pull a handle while he is balanced on a ladder, reducing the likelihood of a fall.

Another object and advantage of the present invention is that it has a housing that encloses the blade when not in use, preventing inadvertent cuts to the operator's body.

Another object and advantage of the present invention is that it automatically ejects the slug after punching, so that the operator is not required to remove the sharp slug with his fingers.

BRIEF DESCRIPTION OF THE DRAWINGS

FIG. 7 is similar to FIG. 5, showing automatic ejection of the slug from the apparatus;

DETAILED DESCRIPTION OF THE PREFERRED EMBODIMENT

Figure 2:
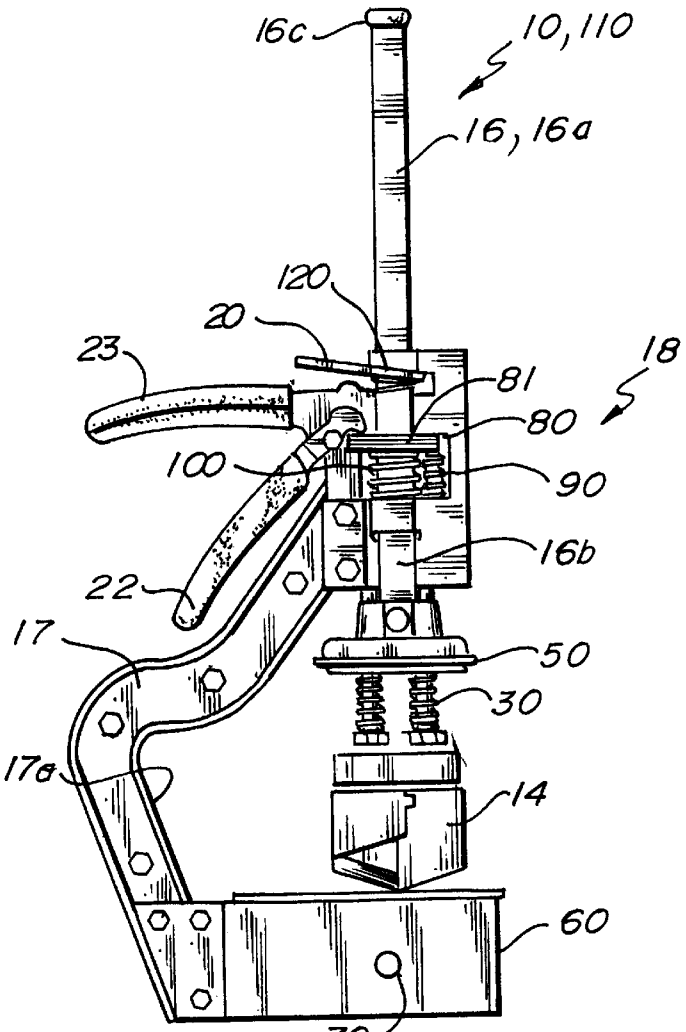
FIG. 2 is a right side elevational view of the apparatus of the present invention.
Figure 1:
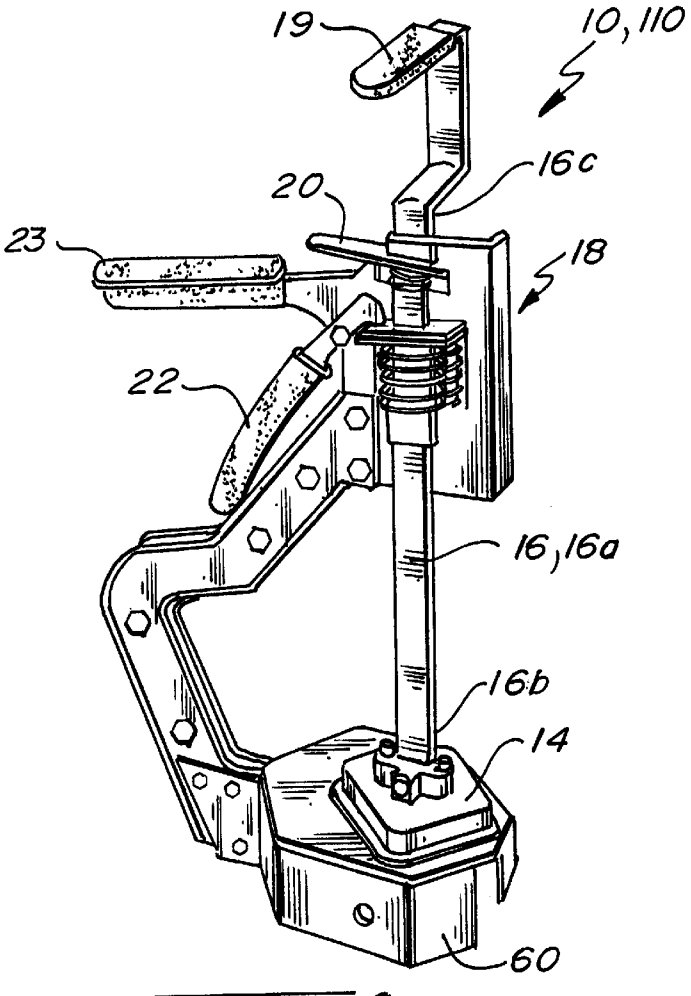
FIG. 1 is a perspective view of the apparatus of the present invention.

In one aspect, the present invention comprises a sheet metal punch 10 adapted to punch a slug out of a workpiece W.

The sheet metal punch 10 further comprises a female die 12 and a male cutting die 14 adapted to mate with the female die 12 and punch a slug S out of the workpiece W, the workpiece W being positioned between the male cutting die 14 and the female die 12 for punching.

The male cutting die 14 is attached to a moving member 16 for positioning against the workpiece W.

A ratchet 18 engages the moving member 16 for incremental movement of the male cutting die 14 toward the workpiece W and the ratchet prevents movement of the male cutting die 14 away from the workpiece W.

A ratchet release 20 allows movement of the male cutting die 14 away from the workpiece W.

Figure 8:
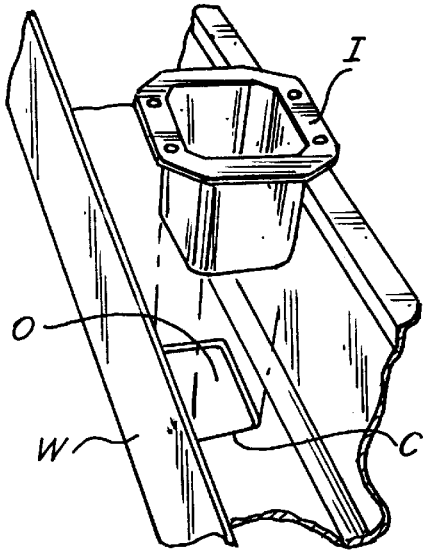
FIG. 8 shows placement of an insert into the punched outlet.
Figure 10A:
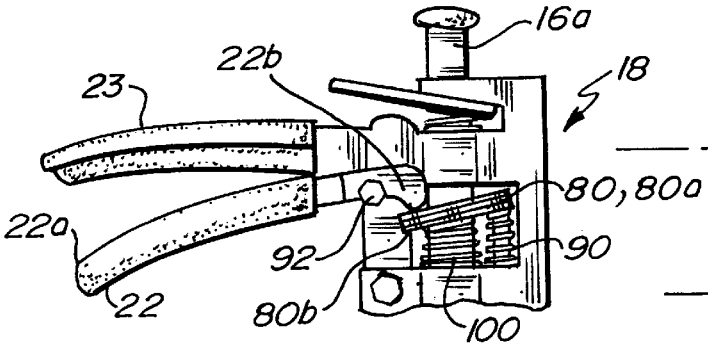
FIG. 10*a* is similar to FIG. 9*a*, but shows the ratchet being used to move the male die toward the gutter.

In a second aspect, the present invention is a gutter outlet punch 110 for punching an outlet O in a rain gutter W (see FIG. 8).

The gutter outlet punch 110 further comprises a female die 12 and a male cutting die 14 adapted to mate with the female die 12 and punch a slug out of the rain gutter W, the rain gutter W being positioned between the male cutting die 14 and the female die 12 for punching.

A grip 17 may be provided for transporting the punch 110. As can be seen, the grip 17 is preferably curved so as to provide a bend 17*a* to allow the rain gutter W to be inserted in the punch.

The gutter outlet punch 110 further comprises a rod 16*a* having a first end 16*b* and a second end 16*c*, the male cutting die 14 being attached to the first end 16*b*. An operating handle 19 may be attached to the second end 16*c*.

The gutter outlet punch 110 further comprises a ratchet 18 for incremental, one way movement of the male cutting die toward the rain gutter W.

A ratchet handle 22 engages the ratchet 18. A stationary handle 23 may also be provided so that the operator may grip the ratchet handle 22 and stationary handle 23 with one hand, operating the ratchet handle by squeezing it.

A ratchet release 20 allows movement of the male cutting die 12 away from the rain gutter W.

In respect to both of the above aspects of the invention, the punch 10, 110 may preferable further comprise spring means 30 engaging the workpiece or rain gutter W during punching, the spring means 30 being biased against the workpiece or rain gutter W and the spring means 30 urging the slug away from the workpiece or rain gutter W after punching.

Figure 4:
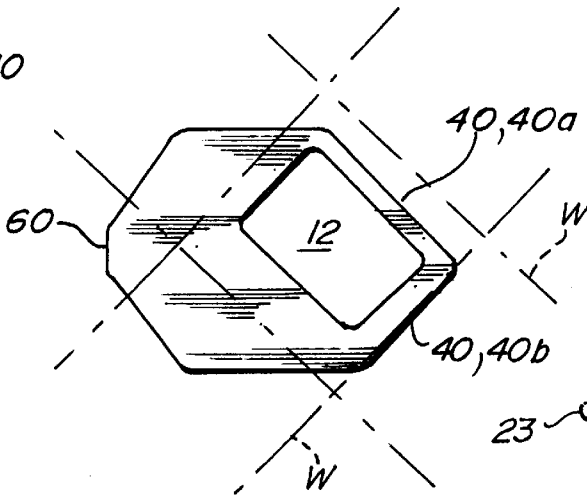
FIG. 4 is a detailed plan view of the housing of the present invention, showing a rain gutter positioned thereon in two different orientations.

In respect to both of the above aspects of the invention, the punch 10, 110 may preferably further comprise alignment means 40 for aligning the workpiece or rain gutter W with the male cutting die 14 in two alternate orthogonal orientations, as shown in FIG. 4.

In respect to both of the above aspects of the invention, the punch 10, 110 may preferably further comprise a step 50 adapted to create a collar C in the workpiece or rain gutter W adjacent the punched outlet O. The collar O assists in forming a seal with an insert I which is inserted into the outlet O for later attachment to a downspout (not shown).

In respect to both of the above aspects of the invention, the punch 10, 110 may preferably further comprise a housing 60 surrounding the female die 12 adapted to enclose the male cutting die 14 and thereby prevent contact between the male cutting die 14 and the operator.

Preferably, the alignment means 40 comprises edges 40*a*, 40*b* of the housing 60. See FIG. 4.

In respect to both of the above aspects of the invention, the punch 10, 110 may preferably further comprise a mounting means 70 for mounting the housing 60 to a bench (not shown). The mounting means 70 may be any equivalent means such as screws, bolts, nails, cotter pins, etc. mating with holes 70 in the housing 60.

Figure 9A:
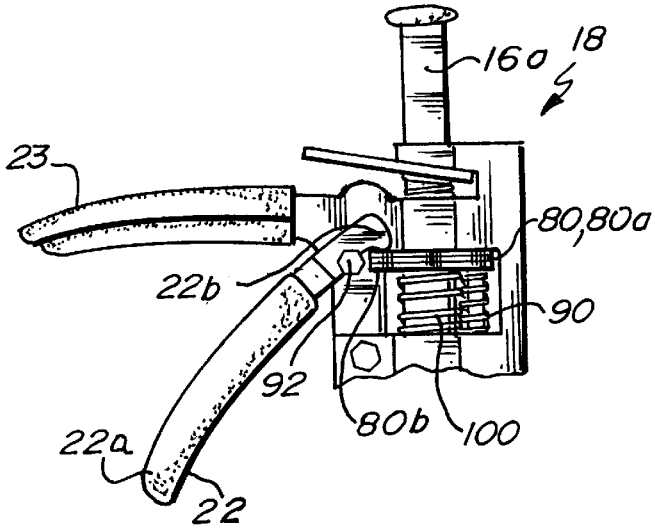
FIG. 9*a* is a detailed elevational view of the ratchet mechanism of the apparatus.
Figure 9C:
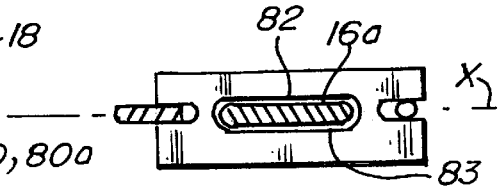
FIG. 9*c* is a cross-section taken approximately along the lines 9*c* of FIG. 9*b;*
Figure 9B:
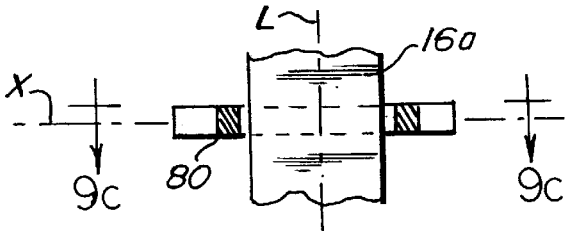
FIG. 9*b* is a detailed view of the chock of the apparatus in position to slide along the rod.

In respect to the second aspect of the invention, the rod 16*a* preferably has a rectangular cross-section and a longitudinal axis L (FIGS. 9*b*, 9*c*). The ratchet 18 further comprises a chock 80 with an aperture 82 and an axis X. The aperture 82 has substantially the same dimensions as the rod's rectangular cross-section, as best seen in FIG 9*c*. However, a slight gap 83 between the rod 16*a* and the aperture 82 allows sliding movement of the rod 16*a* in the aperture 82, as will be further described.

The chock 80 may be composed of a plurality of conjoined members 81, providing structural strength.

Figure 10B:
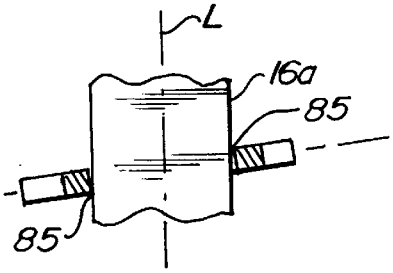
FIG. 10*b* is a detailed view of the chock of the apparatus in position to grip the rod.

When the chock's axis X is substantially perpendicular to the rod's longitudinal axis L (FIG. 9*b*), the rod 16*a* moves freely in the aperture 82. However, when the chock's axis X is not substantially perpendicular to the rod's longitudinal axis L (FIG. 10*b*), the corners 85 of the aperture 82 grip the rod 16*a*, preventing movement of the rod 16*a* through the aperture 82.

The ratchet 18 also preferably comprises a compression spring 90 urging the chock's axis X away from perpendicularity with the rod's longitudinal axis L. Most preferably the chock 80 has a first end 80*a* and a second end 80*b* and the compression spring 90 engages the first end 80*a* and the ratchet handle 22 engages the second end 80*b*, with the ratchet handle being pivotally attached to the punch at a pivot point 92.

Preferably, the distance from the ratchet handle 22 first end 22*a* to the pivot point 92 is at least eight times the distance from the pivot point 92 to the ratchet handle 22 second end 22*b*, thus providing a mechanical advantage of at least 8 to 1.

The ratchet 18 also preferably comprises a driving spring 100 engaging the chock 80 and urging the chock 80 away from the female die 12.

The ratchet release 20 preferably comprises a second chock 120 with an aperture 122 therethrough and an axis X'. The aperture 122 has substantially the same dimensions as the rod's rectangular cross-section, but there is a small gap 123 between the rod 16*a* and the aperture 122.

Figure 11A:
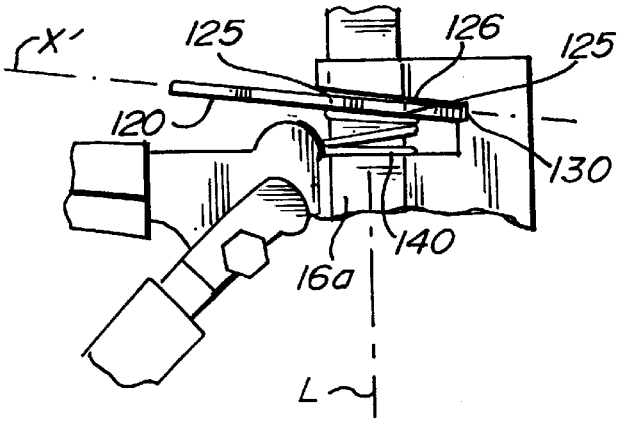
FIG. 11*a* is a detailed view of the ratchet release of the apparatus of the present invention, with the ratchet release gripping the rod.
Figure 11B:
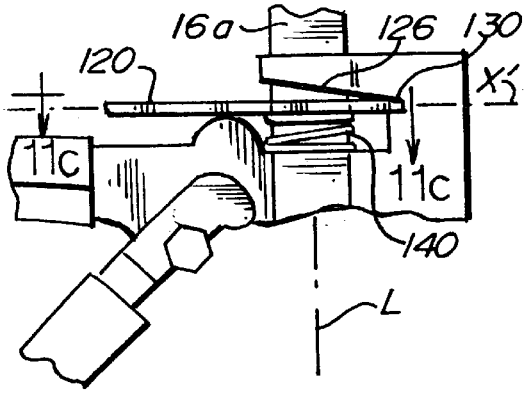
FIG. 11*b* is similar to FIG. 11*a*, but shows the ratchet release in the released position, not gripping the rod.
Figure 12:
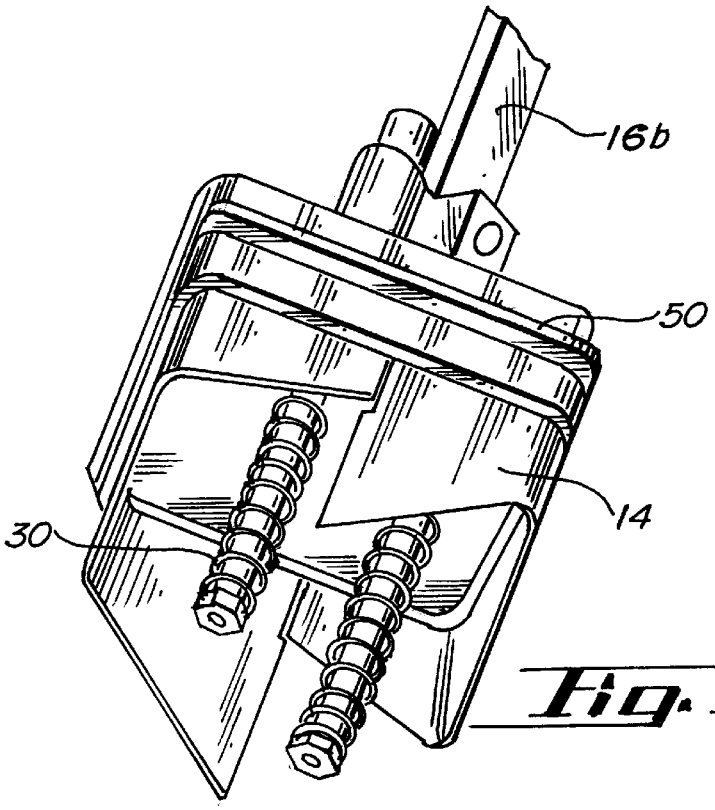
FIG. 12 is a bottom perspective view of the male cutting die of the present apparatus.
Figure 11C:
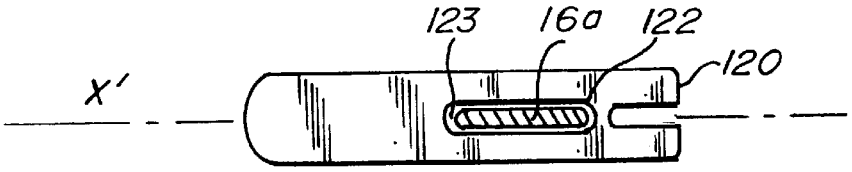
FIG. 11*c* is a cross-section taken approximately along the lines 11*c* of FIG. 11*b*.

When the second chock's axis X' is substantially perpendicular to the rod's longitudinal axis L (FIG. 11*b*), the rod 16*a* moves freely in the aperture 122. However, when the second chock's axis X' is not substantially perpendicular to the rod's longitudinal axis L (FIG. 11*a*), the comers 125 of the aperture 122 grip the rod 16*a*, preventing movement of the rod 16*a* through the aperture 122 in a direction away from the female die 12 because the second chock 120 butts against the stop 126. However, the rod 16*a* may still move toward the female die 12.

The second chock 120 is pivotally attached to the punch at a second pivot point 130. A release spring 140 urges the second chock's axis X' away from perpendicularity with the rod's longitudinal axis L.

Operation of the invention may now be described, with reference to the Figures.

Figure 5:
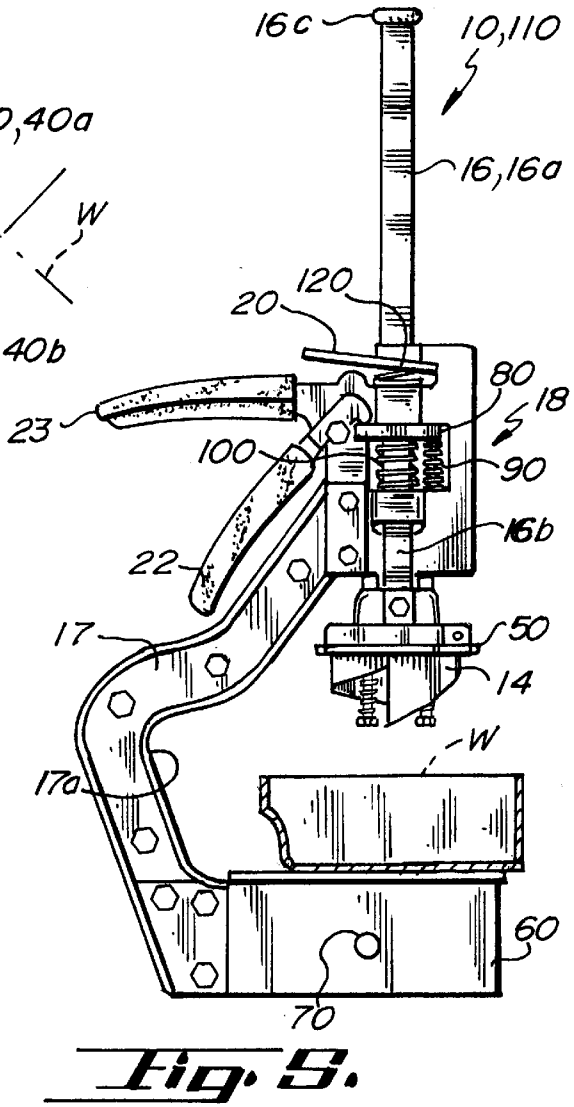
FIG. 5 is similar to FIG. 2, showing the male die raised to allow insertion of a rain gutter into the apparatus.

With the male cutting die raised away from the female die (FIG. 5), the workpiece or rain gutter W is placed on the housing 60 with the desired location for the punched outlet over the female die 12. See FIG. 4. The punched outlet may be created with its longer dimension parallel to the sides of the rain gutter or perpendicular to the sides of the rain gutter by orienting one side of the rain gutter W parallel with either the edge 40*a* or the edge 40*b*. The bend in the grip 70 allows the workpiece or rain gutter W to be placed on the housing 60.

Figure 3:
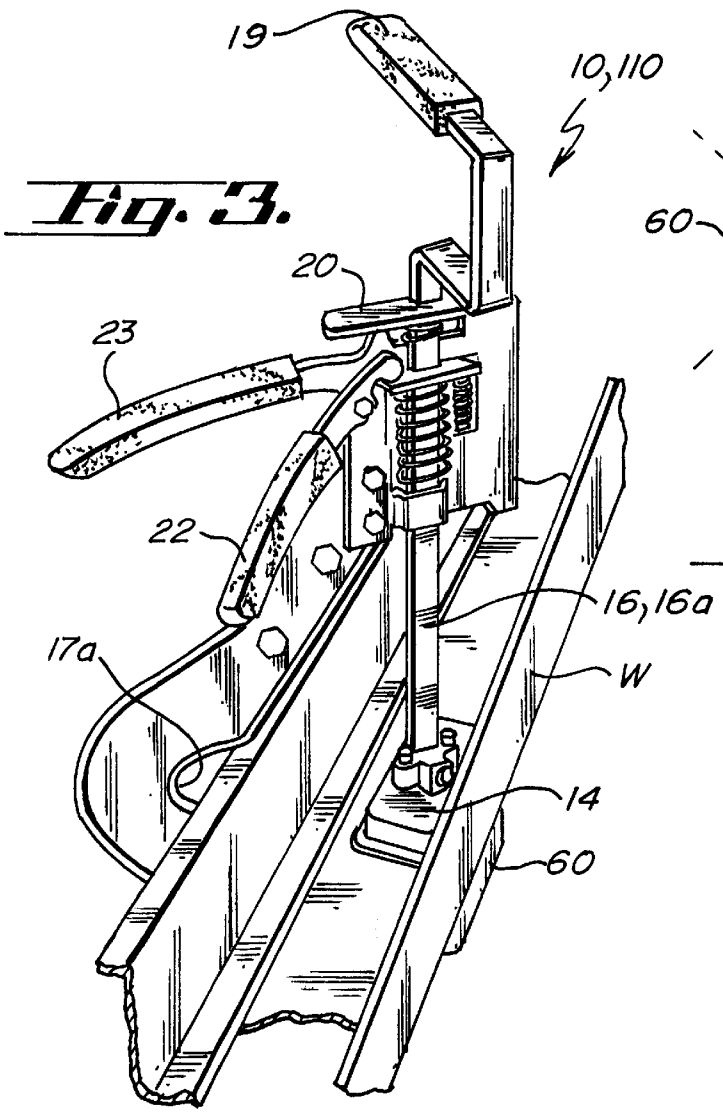
FIG. 3 is a perspective view of the apparatus of the present invention positioned in a rain gutter.
Figure 4:
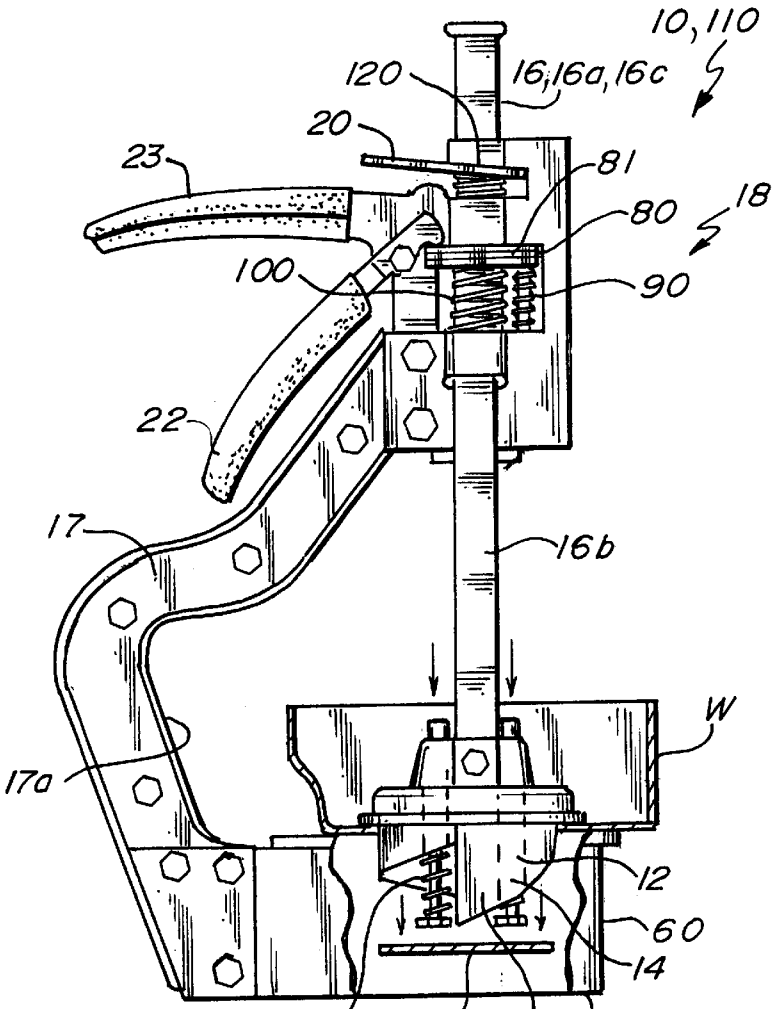

The male cutting die 14 is then lowered against the workpiece or rain gutter W by using the operating handle 19. See FIG. 3.

Next, the operator squeezes the handles 22, 23 repeatedly, causing the ratchet 18 to move the rod 16*a* against the workpiece or rain gutter W, as the male cutting die penetrates the workpiece or rain gutter W. It will be clear to one of ordinary skill in the art that the operator can squeeze the handles 22, 23 using only one hand, and may therefore use his other hand to hold onto the ladder or the rain gutter.

It will be seen that as the operator squeezes the handles 22, 23, the end 22*b* of the ratchet handle 22 will force the end 80*b* of the chock downward. This allows the compression spring 90 to force the other end 80*a* of the chock upward, resulting in the chock's axis X quickly moving out of perpendicularity with the longitudinal axis L of the rod 16*a*. As the comers 85 of the chock 80 grip the rod 16*a*, the rod moves downward toward the housing. Any upward movement of the rod 16*a* is prevented by the ratchet release 20. The chock 80 and ratchet handle 22 are moved to their starting positions between strokes by the driving spring 100.

Figure 6:
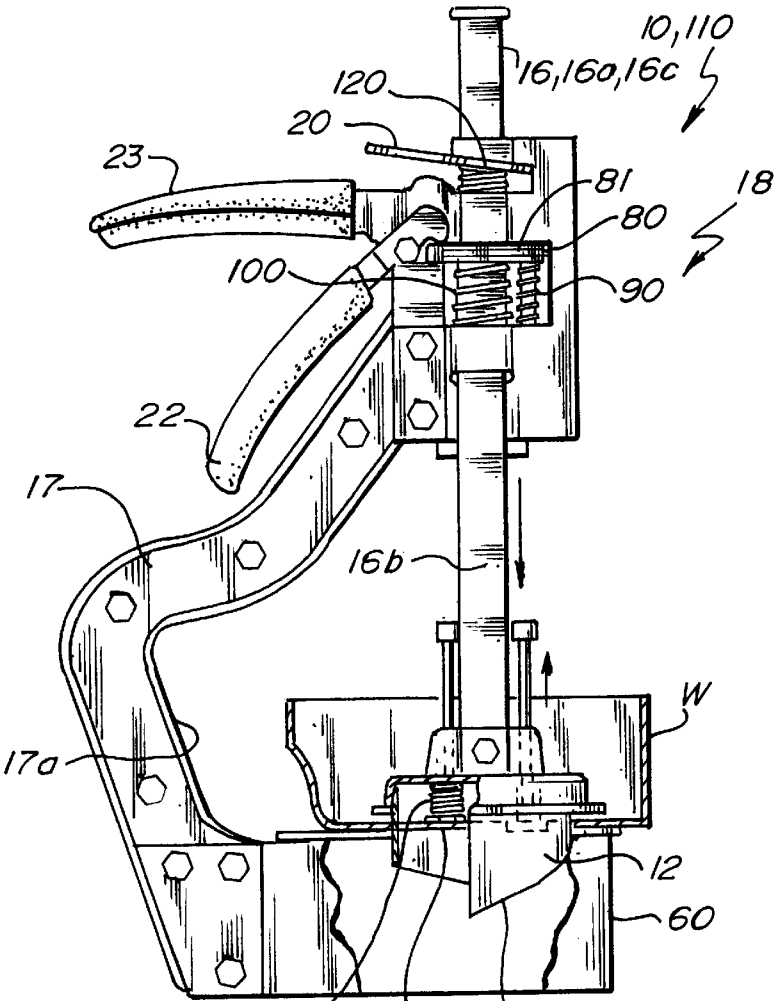
FIG. 6 is similar to FIG. 5, showing the mail die punching through the rain gutter.

As the male cutting die 14 is penetrating the workpiece or rain gutter W, the spring means 30 is compressed between the male cutting die 14 and the workpiece. See FIG. 6.

When the male cutting die 14 completes cutting the slug S out of the workpiece or rain gutter W, the spring means 30 expands, pushing the slug S away from the workpiece or rain gutter W. See FIG. 7. Preferably, the housing 60 has an open bottom 61, and the slug S then falls out of the housing 60. See FIG. 7.

Because the slug is ejected automatically, there is no need for the operator to insert his fingers into the apparatus to remove the slug, thus avoiding possible cuts to his fingers.

After the slug S is cut out, the operator squeezes the handles 22, 23 again, causing the step 50 to create the collar C around the punched outlet O. The collar allows an insert to be placed into the outlet with a very good seal.

The operator then presses the ratchet release 20, allowing the rod 16*a* to be raised away from the housing 60 using the operating handle 19.

The workpiece or rain gutter W may then be removed from the punch, and an insert I is placed in the outlet O (FIG. 8).

For transportation, the operating handle 19 is used to move the male cutting die 14 into the housing 60, so that the operator is in no danger of contacting the male cutting die. The operator may then carry the punch using the grip 70.

Optionally, the punch 10, 110 may be mounted on a bench (not shown) for operation using mounting means 70.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A sheet metal punch adapted to punch a slug out of a workpiece, comprising:

(a) a female die;

(b) a male cutting die adapted to mate with the female die and punch a slug out of the workpiece, the workpiece being positioned between the male die and the female die for punching;

(c) a rod having a first end and a second end, the male cutting die being attached to the first end;

(d) a ratchet for incremental, one way movement of the male cutting die toward the workpiece;

(e) a ratchet handle engaging the ratchet;

(f) a ratchet release; and (g) wherein the male cutting die further comprises a step adapted to create a collar in the workpiece adjacent the removed slug.

2. The punch of claim 1, further comprising spring means engaging the workpiece during punching, the spring means being biased against the workpiece and the spring means urging the slug away from the workpiece after punching.

3. The punch of claim 1, further comprising alignment means for aligning the workpiece with the male cutting die in two alternate orthogonal orientations.

4. The punch of claim 1, further comprising a housing surrounding the female die adapted to enclose the male cutting die and thereby prevent contact between the male cutting die and the operator.

5. The punch of claim 4, further comprising mounting means on the housing for mounting the housing to a bench.

6. A gutter outlet punch for punching an outlet in a rain gutter, comprising:

(a) a female die;

(b) a male cutting die adapted to mate with the female die and punch a slug out of the rain gutter, the rain gutter being positioned between the male die and the female die for punching;

(c) a rod having a first end and a second end, the male cutting die being attached to the first end;

(d) a ratchet for incremental, one way movement of the male cutting die toward the rain gutter;

(e) a ratchet handle engaging the ratchet; and (f) a ratchet release.

7. The punch of claim 6, further comprising spring means engaging the rain gutter during punching, the spring means being biased against the rain gutter and the spring means urging the slug away from the rain gutter after punching.

8. The punch of claim 6, further comprising alignment means for aligning the rain gutter with the male cutting die in two alternate orthogonal orientations.

9. The punch of claim 6, wherein the male cutting die further comprises a step adapted to create a collar in the rain gutter adjacent the removed slug.

10. The punch of claim 6, further comprising a housing surrounding the female die adapted to enclose the male cutting die and thereby prevent contact between the male cutting die and the operator.

11. The punch of claim 10, further comprising mounting means on the housing for mounting the housing to a bench.

12. The punch of claim 6, wherein the rod has a rectangular cross-section and a longitudinal axis and wherein the ratchet further comprises a chock with an aperture therethrough and an axis, the aperture having substantially the same dimensions as the rod's rectangular cross-section, wherein the rod moves freely in the aperture when the chock's axis is substantially perpendicular to the longitudinal axis and wherein the chock grips the rod when the chock's axis is not substantially perpendicular to the longitudinal axis.

13. The punch of claim 12, wherein the ratchet further comprises a compression spring urging the chock's axis away from perpendicularity with the rod's longitudinal axis.

14. The punch of claim 13, the chock having a first end and a second end, the compression spring engaging the first end and the ratchet handle engaging the second end, the ratchet handle being pivotally attached to the punch at a pivot point.

15. The punch of claim 14, further comprising a driving spring engaging the chock and urging the chock away from the female die.

16. The punch of claim 15, wherein the ratchet release further comprises a second chock with an aperture therethrough and an axis, the aperture having substantially the same dimensions as the rod's rectangular cross-section, wherein the rod moves freely in the aperture when the second chock's axis is substantially perpendicular to the longitudinal axis and wherein the second chock grips the rod when the second chock's axis is not substantially perpendicular to the longitudinal axis.

17. The punch of claim 16, the second chock being pivotally attached to the punch at a second pivot point and further comprising a release spring urging the second chock's axis away from perpendicularity with the rod's longitudinal axis.

18. The punch of claim 6, further comprising a handle on the rod's second end.

19. The punch of claim 12, wherein the chock further comprises a plurality of conjoined members, each having an aperture therethrough.

20. A gutter outlet punch for punching an outlet in a rain gutter, comprising:

(a) a female die;

(b) a male cutting die adapted to mate with the female die and punch a slug out of the rain gutter, the rain gutter being positioned between the male die and the female die for punching;

(c) a rod having a first end and a second end, the male cutting die being attached to the first end;

(d) a ratchet for incremental, one way movement of the male cutting die toward the rain gutter;

(e) a ratchet handle engaging the ratchet and a stationary handle attached to the punch, wherein the ratchet handle and stationary handle are adapted to permit one-handed operation of the ratchet;

(f) a ratchet release;

(g) alignment means for aligning the rain gutter with the male cutting die in two alternate orthogonal orientations; and (h) a housing surrounding the female die and adapted to enclose the male cutting die and thereby prevent contact between the male cutting die and the operator.

21. The punch of claim 20, wherein the alignment means further comprises edges of the housing.

22. A sheet metal punch adapted to punch a slug out of a workpiece, comprising:

(a) a female die;

(b) a male cutting die adapted to mate with the female die and punch a slug out of the workpiece, the workpiece being positioned between the male die and the female die for punching;

(c) the male cutting die being attached to a moving member for positioning against the workpiece;

(d) a ratchet engaging the moving member for incremental movement of the male cutting die toward the workpiece and the ratchet preventing movement of the male cutting die away from the workpiece;

(e) a ratchet release allowing movement of the male cutting die away from the workpiece; and (f) wherein the male cutting die further comprises a step adapted to create a collar in the workpiece adjacent the removed slug.

* * * * *